US010661954B2

(12) United States Patent
Fresnel

(10) Patent No.: US 10,661,954 B2
(45) Date of Patent: May 26, 2020

(54) SECURITY COVER AND A CONTAINER COVERED WITH SUCH A COVER

(71) Applicant: SLEEVER INTERNATIONAL COMPANY, Morangis (FR)

(72) Inventor: Eric Fresnel, Paris (FR)

(73) Assignee: SLEEVER INTERNATIONAL COMPANY, Morangis (FR)

( * ) Notice: Subject to any disclaimer, the term of this patent is extended or adjusted under 35 U.S.C. 154(b) by 137 days.

(21) Appl. No.: 15/785,941

(22) Filed: Oct. 17, 2017

(65) Prior Publication Data

US 2018/0118432 A1 May 3, 2018

(30) Foreign Application Priority Data

Nov. 3, 2016 (FR) ..... 16 60632
Aug. 1, 2017 (FR) ..... 17 57393

(51) Int. Cl.
*B65D 55/08* (2006.01)
*B65D 39/00* (2006.01)
*B65D 51/18* (2006.01)

(52) U.S. Cl.
CPC ..... *B65D 55/08* (2013.01); *B65D 39/0005* (2013.01); *B65D 51/18* (2013.01); *B65D 55/0854* (2013.01)

(58) Field of Classification Search
CPC .... B65D 55/08; B65D 55/06; B65D 55/0854; B65D 39/0005; B65D 39/00; B65D 51/18; B65D 51/185; B65D 51/24; B65D 41/54; B65D 41/62; B65D 41/48; B65D 43/0256; B65D 1/0238; B65D 17/402
USPC ..... 215/246, 254, 253, 250, 228, 364, 355; 220/266, 265, 260, DIG. 3, 212; 229/89; 53/441
See application file for complete search history.

(56) References Cited

U.S. PATENT DOCUMENTS 2,018,019 A * 10/1935 Grauer ..... B65D 49/04 215/25
2,141,744 A * 12/1938 Evans ..... B65D 41/24 215/246
2,227,682 A * 1/1941 Worth ..... B29C 48/10 264/78
2,361,464 A * 10/1944 Edwards ..... B65D 55/0854 215/246
3,951,292 A * 4/1976 Amberg ..... B29C 61/025 215/230
4,009,793 A 3/1977 Minesinger et al.
(Continued)

FOREIGN PATENT DOCUMENTS

BG 1 148 U1 2/2009
FR 2 598 389 A1 11/1987
(Continued)

*Primary Examiner* — Robert J Hicks
(74) *Attorney, Agent, or Firm* — Muncy, Geissler, Olds & Lowe, P.C.

(57) ABSTRACT

The invention relates to a security cover designed to surround a container, the cover comprising a sleeve (1) and a security strip (2) secured to an inside face of said sleeve and including at least one zone of weakness, the security strip being shaped so that when in service it surrounds the container below a finish of the container and in the immediate proximity of said finish, the security strip thus creating a compression zone compressing the container. The invention also relates to a container covered with such a cover.

19 Claims, 5 Drawing Sheets

(56) References Cited

U.S. PATENT DOCUMENTS

| | | | | | |
|---|---|---|---|---|---|
| 4,538,740 | A * | 9/1985 | Petersen, Jr. | ..... | B65D 55/0854 215/246 |
| 5,292,018 | A * | 3/1994 | Travisano | ..... | B65D 55/0854 215/246 |
| 6,113,720 | A * | 9/2000 | Fresnel | ..... | B65C 3/065 156/85 |
| 6,254,139 | B1 * | 7/2001 | Fresnel | ..... | B65D 55/026 283/72 |
| 2009/0020535 | A1 * | 1/2009 | Joubert | ..... | B65D 23/085 220/521 |
| 2010/0096355 | A1 * | 4/2010 | Chaolu | ..... | B65D 41/42 215/304 |
| 2010/0282637 | A1 * | 11/2010 | Clark, Jr. | ..... | B65D 75/46 206/581 |
| 2017/0043921 | A1 * | 2/2017 | Elliott | ..... | B65D 39/08 |

FOREIGN PATENT DOCUMENTS

| | | | | | |
|---|---|---|---|---|---|
| FR | 2698851 | A1 * | 6/1994 | ..... | B65D 23/0878 |
| FR | 2 754 375 | A1 | 4/1998 | | |
| FR | 2 778 892 | A1 | 11/1999 | | |
| FR | 3 003 549 | A1 | 9/2014 | | |
| JP | H08 22250 | A | 1/1996 | | |

* cited by examiner

SECURITY COVER AND A CONTAINER COVERED WITH SUCH A COVER

The invention relates to a security cover, in particular for containers, that is suitable for detecting when such a container has been tampered with. The invention also relates to a container covered with such a security cover.

TECHNOLOGICAL BACKGROUND OF THE INVENTION

In certain fields, it is important to provide containers with devices that guarantee that they have not been opened, in particular for the purpose of avoiding tampering of the container-refilling fraud type.

In the field of wine and spirit bottles, it is thus known to overmold the stopper by means of a capsule that is pressed onto the bottle or that is crimped onto the bottle.

However, dishonest people have hardly any trouble replacing an initial capsule with another such that a simple sealing capsule does not provide sufficient protection.

Thus, in an attempt to reinforce protection, it is known at present to cover the stoppered neck of the container with a sleeve made of heat-shrink plastic. In order to open the container, it is necessary to remove the heat-shrink sleeve, which involves destroying the sleeve.

Nevertheless, it has been found that certain dishonest people nevertheless manage to put the sleeve back into place, or to fit a new sleeve that they heat-shrink directly onto the container. Proposals have since been made to use sleeves that are more sophisticated, thereby enabling protection against opening to be enhanced.

A need has thus emerged for providing protection against opening that is more sophisticated.

In this respect, in Document FR 2 754 375, the Applicant has proposed a security cover comprising a sleeve of heat-shrink plastics material fitted on its inside face with a holographic element and with a tear strip passing across the holographic element in order to cause the holographic element to be torn when the cover is opened. The holographic element is transferable onto the facing wall of the container, so that any manipulation of the security cover has the effect of automatically destroying the transferred holographic element.

In document FR 3 003 549, the Applicant has also proposed a sleeve made of heat-shrink plastics material fitted on its outside face with a security strip made of a multi-layer material that can be delaminated, the sleeve presenting at least one line of cut passing under the strip. Thus, during an attempt at removing the sleeve, the sleeve will tear along the line of cut, thereby causing the strip to delaminate at least in part, and thus leaving a visible trace of tampering on the sleeve.

Document U.S. Pat. No. 4,009,793 proposes surrounding the stopper of a bottle with a self-adhesive tape or strip made of heat-shrink material associated with a tear strip made of non heat-shrink material.

However that solution presents numerous limits and in particular can only be applied to zones of small and uniform dimensions. Furthermore, it is found to be very simple to replace the strip with a new strip covering any remnants of the first strip.

OBJECT OF THE INVENTION

The invention seeks to propose a novel security cover, in particular for containers, that presents an enhanced level of security. The invention also proposes a container covered with such a cover.

PRESENTATION OF THE INVENTION

In order to achieve this object, the invention provides a security cover designed to surround a container, the cover comprising a sleeve and a security strip secured to an inside face of said sleeve and including at least one zone of weakness, the security strip being shaped so that when in service it surrounds the container below a finish of the container and in the immediate proximity of said finish, the security strip thus creating a compression zone compressing the container.

Advantage is thus taken of the junction point between the finish and a neck of the container, the junction point naturally forming a blocking and retaining zone due to its shape, in order to place the security strip in a location where it is necessarily strongly stressed. Furthermore, the security strip together with the sleeve exerts a compression force on the container likewise strongly stressing the security strip when the outside of the sleeve is touched.

Thus, during an attempt to remove the sleeve, the security strip is very strongly stressed due to its arrangement just below the finish of the container and due to it being tight around the container. Consequently, the zone of weakness will change state, thereby leaving a visible trace that the sleeve has been manipulated, in particular that the sleeve has been tampered with.

In the present application, "container" refers to a container comprising at least a body, a neck extending the top portion of the body, and a finish forming the open end of the container and itself extending the neck. The finish may take various forms and thus be flat, square, . . . . In any event, the finish co-operates with the neck to define a shoulder at the junction point between the finish and the neck. The finish is also known as a "penicillin finish" (in French "bague à carnette"), the raised ring (or lip)(in French "la carnette") of the finish partly forming said shoulder with the neck.

In particular manner, the zone of weakness forms a rupture zone of the security strip.

In particular manner, the zone of weakness is thus formed by a cut in the security strip.

In particular manner, the security strip is shaped like a crown.

In particular manner, at least a portion of the security strip is in contact with a lip of the container.

In particular manner, the security strip further comprises at least one security sign.

In particular manner, the sleeve includes at least one line of cut extending at least in part in a portion of the sleeve covering the security strip.

In particular manner, the sleeve is shaped into a capsule.

In particular manner, the capsule is shaped into a truncated cone.

In particular manner, the cover further comprises a protection washer for a stopper of the container.

In particular manner, the capsule comprises a circumferential trough, the washer resting on the trough.

In particular manner, the washer is arranged inside the sleeve between the trough and an inside face of a top base of the capsule.

In particular manner, the washer is secured to the sleeve.

In particular manner, the security strip is in two portions.

The invention also relates to a container covered with such a cover.

Other characteristics and advantages of the invention appear on reading the following description of particular, non-limiting embodiments of the invention.

DESCRIPTION OF THE FIGURES

The invention can be better understood in the light of the following description made with reference to the accompanying figures, in which.

DETAILED DESCRIPTION OF EMBODIMENTS OF THE INVENTION

Figure 1:
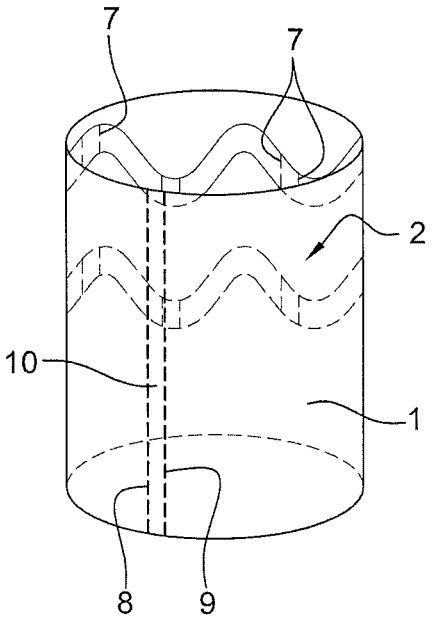
FIG. 1 is a diagrammatic perspective view of a security cover in a first embodiment of the invention.

With reference to FIGS. 1 to 4, the security cover of the first embodiment of the invention comprises a sleeve 1, which in this embodiment is of heat-shrink plastics material that is cut from a sheath made using a film of said material. By way of example, the sleeve 1 is made from a single layer film. Alternatively, the sleeve 1 is made of a multilayer heat-shrink material. By way of example, the sleeve 1 is based on polyester (such as polyethylene terephthalate (PET)). In this embodiment, the sleeve is 1 stretched to provide it with a single privileged shrinkage direction.

By way of example, the sleeve 1 is transparent i.e. it enables items to be seen clearly therethrough. In this embodiment, the sleeve 1 is transparent over its entire surface.

The sleeve 1 is provided on its inside face (i.e. the face for coming into contact with the container to be covered) with a security strip 2. In this embodiment, the security strip 2 extends substantially over the entire circumference of the sleeve 1. When the sleeve is put into place on a container 3, such as a bottle, the security strip 2 thus extends substantially horizontally.

The sleeve 1 is thus held in place on the container 3 by heat shrinking. The sleeve 1 is therefore not self-adhesive.

The sleeve 1 is made of a heat-shrink material that makes it possible to control the compression force exerted by the sleeve 1 on the container 3. This makes it possible to optimize adherence of the sleeve 1 to the container 3 and thus to increase its resistance to tearing and to increase the security of the container 3.

The security strip 2 thus surrounds the container 3 below a finish 4 of the container 3 and in the immediate proximity of said finish 4 once the security cover has been shrunk onto the container 3. More precisely, the security strip 2 is arranged at the junction point between the finish 4 and the neck 5 of the container 3. The security strip 2 is arranged immediately below the lip 6. Thus, the security strip 2 forms a compression band around the container 3 once the security cover has been shrunk onto the container 3.

In advantageous manner, it should be observed that the security strip 2 exerts a compression force, but that the sleeve 1 also exerts a compression force by being shrunk onto the container 3. It is thus possible, to act on the compression forces exerted respectively by the security strip 2 and by the sleeve 1, and by way of example it is possible to shape the security strip 2 and the sleeve 1 together so that the security strip 2 and the sleeve 1 exert different compression forces on the container 3 or on the contrary the same compression force.

In addition, it should be observed further that the compression force on the container 3 at the security strip 2 is defined both by the security strip itself (dimensions, shape, material, . . . of the security strip 2) and also by the sleeve 1 (dimensions, shape, material, . . . of the sleeve 1) that surrounds the security strip 2. Thus, it is possible to act both on the security strip 2 and on the sleeve 1 in order to define the compression of the security strip 2 on the container 3.

In this embodiment, the security strip 2 is cut from a flat material and then applied and secured to the inside face of the sleeve 1, e.g. by adhesive. In a variant, the security strip 2 is cut from a multilayer flat material, including an adhesive layer enabling it to be stuck directly against the sleeve 1.

The security strip 2 is based on plastics material. By way of example, the security strip 2 is based on a thermoplastic polymer. Typically, the security strip 2 is based on polyester.

In particular manner, the material of the security strip 2 is made of heat-shrink material. This facilitates shrinking of the security cover on the container 3.

Preferably, the security strip 2 is shaped so as to present the same heat shrinking characteristics as the sleeve 1.

This uniformity between the security strip 2 and the sleeve 1 allow the cover to shrink even on containers of very complex shapes, e.g. with containers having a difference of diameter between a body and a neck of up to 80%.

The security strip 2 is thus made of a heat-shrink material that makes it possible to control the compression force exerted by the security strip 2 on the container 3. This makes it possible to optimize adherence of the security strip to the container 3 and thus to increase its resistance to tearing and to increase the security of the container 3.

In a variant, the material of the security strip 2 is not a heat-shrink material. This facilitates marking additional security signs directly on the security strip 2 (as described below). In addition, the portion of the sleeve 1 covering the security strip 2 is less subjected to shrinkage than the rest of the sleeve 1, which also facilitates possible marking of security signs on that portion of the sleeve 1. It is naturally also possible to mark security signs on the security strip 2 and/or the sleeve 1 when the security strip 2 is made of heat-shrink material. In this embodiment, the security strip 2 is transparent, i.e. it enables items to be seen clearly therethrough. In this embodiment, the security strip 2 is transparent over its entire surface.

The security strip 2 typically includes a plurality of zones of weakness. In particular manner, the zones of weakness are formed by cuts 7 (represented by dashed lines, with only some of them being given a reference), which cuts are made in the security strip 2 and only in the security strip 2. The cuts 7 do not reach the associated sleeve 1, so it is not weakened by the cuts 7.

The cuts 7 are made in different locations on the security strip 2. In this embodiment, the cuts 7 are shaped so that each cut spans the entire height of the security strip 2. By way of example, the cuts 7 are made by microperforation.

Preferably, the security strip 2 is shaped like a crown, i.e. the compression band that it forms when the sleeve 1 is shrunk onto the container 3 is not a simple annulus.

In this embodiment, the security strip 2 is shaped sinusoidally over the entire circumference of the sleeve 1. The security strip 2 thus presents waves that, in this example, are regular. The security strip 2 thus forms waves over the entire circumference of the sleeve 1.

In preferred manner, the security strip 2 is arranged on the sleeve 1 so that when the sleeve 1 is shrunk onto the container 3, the top portions of the crown formed by the security strip 2 are in contact with the lip 6 of the finish 4.

In addition, the sleeve 1 includes two lines of cut 8, 9 (represented here in dashed lines). By way of example, these lines of cut 8, 9 are made by microperforation.

In this embodiment, said lines of cut 8, 9 are created so as to extend parallel to each other and along a generator line of the sleeve 1. When the sleeve 1 is put into place on the container 3, the lines of cut 8, 9 thus extend substantially vertically. The lines of cut 8, 9 thus present respective segments extending above the security strip 2.

The lines of cut 8, 9 extend in the proximity of one another so that together they define a removable portion 10 that is removed when the sleeve 1 is cut along the lines of cut 8, 9.

Optionally, on its face that is in contact with the container 3 the security strip 2 is coated with a heat activated glue, also known as heat-sensitive adhesive, in such a manner that when the sleeve 1 is shrunk onto the container 3, the security strip 2 sticks to the wall of the container, promoting greater stress later on in the security strip 2 and in particular in its zones of weakness while the container 3 is being manipulated. In envisaged applications, the adhesive covers the face of the security strip 2 in full or in part. By way of example, the adhesive covers only a portion of the zones of weakness of the security strip 2, thereby leading to non-uniformity on the security strip 2 and making it easier to detect that the container 3 has been tampered with.

The cover is then threaded over the container 3, in this embodiment closed by a stopper 11, and then heated to cause the cover (i.e. of the sleeve, and in this embodiment of the strip 2) to heat-shrink onto the neck 5 and the finish 4, so as to cover at least an edge of the stopper 11. Thus, the cover seals the stopper 11 to the finish 4.

Figure 2:
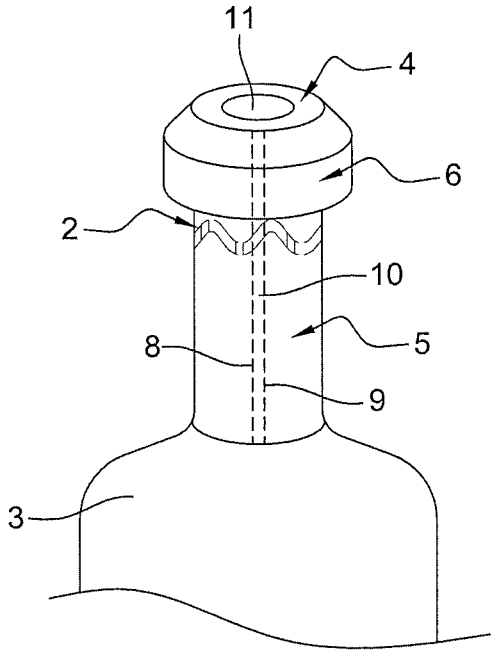
FIG. 2 is a perspective view of a container covered by the FIG. 1 security cover.

The result can be seen in FIG. 2.

It should be observed that in this position, the security strip 2 is indeed arranged directly underneath the finish 4 so that the top portions of the security strip 2 touch the lip 6. The security strip 2 arranged in this way is thus very sensitive to the forces exerted on the finish 6 and/or the neck 5.

Figure 3:
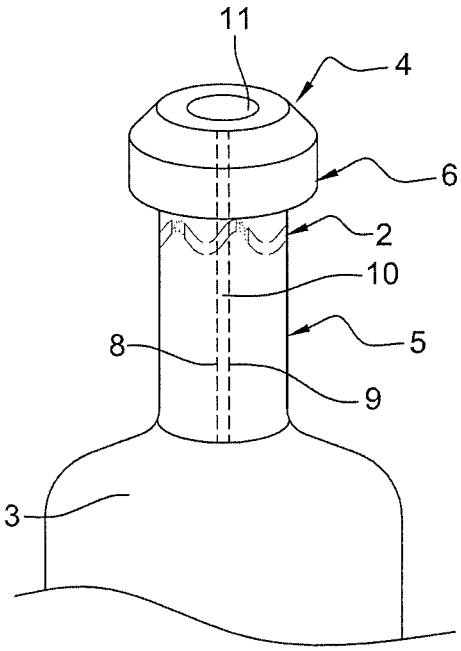
FIG. 3 is a view identical to that of FIG. 2 after an attempt at tampering.

Thus, if the sleeve 1 is forced in order to remove it fraudulently from the container 3, very considerable forces are exerted on the sleeve 1 in particular at the zone of the sleeve 1 that is in contact with the lip 6, which naturally forms a blocking and retaining zone. This causes the security strip 2 to tear at its various zones of weakness. Thus, the security strip 2 is separated into several elements and it is no longer possible to put it back together again, since its constituent elements have been separated and blocked by the sleeve 1 that remains intact on the container 3 (since it is not concerned by these zones of weakness). The attempt at tampering is thus clearly visible as shown in FIG. 3.

If, despite everything, the sleeve 1 is removed by continued pulling thereon, it is no longer possible to put the security strip 2 back together again and it is thus very difficult or even impossible to attempt to put the sleeve 1 back into place on the container 3. Any tampering with the container 3 is thus prevented.

Figure 4:
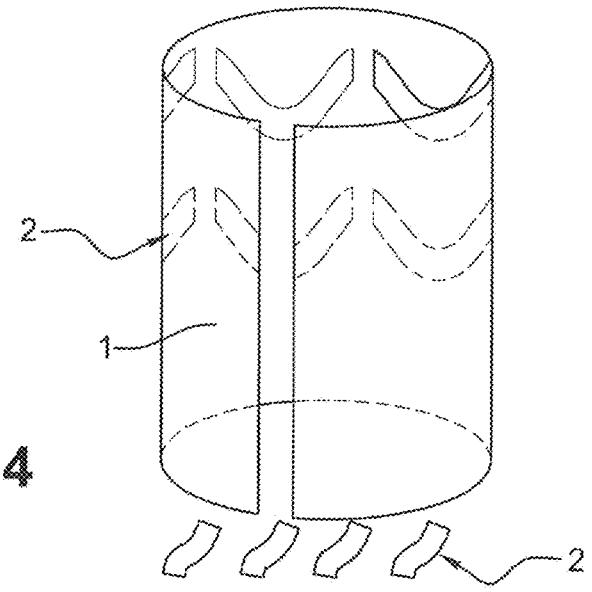
FIG. 4 is a view of the FIG. 1 security cover after it has been opened.

In addition, as shown in FIG. 4, if the sleeve 1 is torn along the lines of cut 8, 9 in order to remove the removable portion 10, this gives rise to numerous stresses on the security strip 2 and in particular on the various zones of weakness, in particular while tearing the portion of the sleeve 1 that covers the security strip 2. This causes the security strip 2 to tear at its zones of weakness: the security strip 2 is thus found separated into several elements and it is no longer possible to put it back together again, since its constituent elements have been separated.

Once again, it is thus very difficult or even impossible to try to put the sleeve 1 back into place on the container 3. Any tampering with the container 3 is thus prevented.

Figure 5:
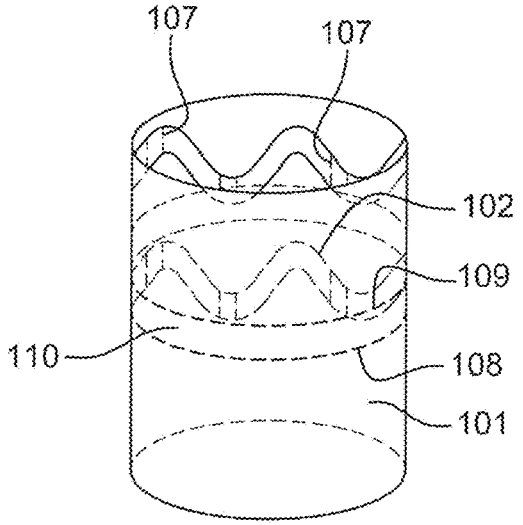
FIG. 5 is a diagrammatic perspective view of a security cover in a second embodiment of the invention.

The security strip 2 is therefore very effective for combating tampering with containers. In a second embodiment shown in FIG. 5, the cover is identical to that of the first embodiment, with the difference being that the lines of cut 108, 109 of the sleeve 101 are arranged so as to extend substantially over the circumference of the sleeve 101 and no longer along a generator line of the sleeve 101.

In this embodiment, the lines of cut 108, 109 are arranged so that one of the lines 108 extends over a portion of sleeve 101 not covering the security strip 102, being situated underneath the portion of sleeve 101 that covers the security strip 102, and so that the other line 109 extends over the portion of sleeve 101 that covers the security strip 102. Thus, the removable portion 110 defined by the two lines of cut 108, 109 overlaps the portion of sleeve 101 covering the security strip 102.

In a variant, the lines of cut 108, 109 are arranged in such a manner that the removable portion 110 is arranged entirely on the portion of the sleeve 101 covering the security strip 102.

Figure 6:
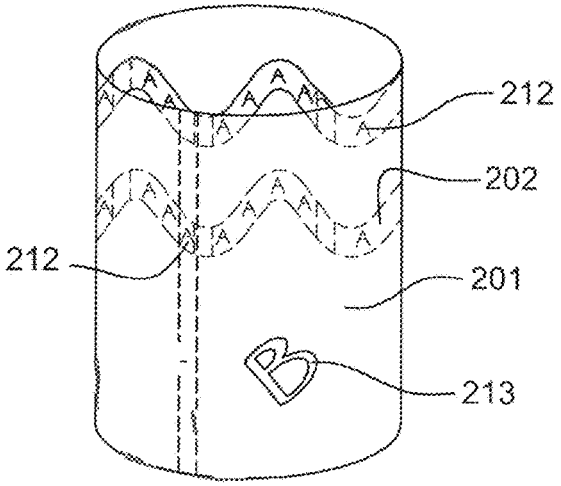
FIG. 6 is a diagrammatic perspective view of a security cover in a third embodiment of the invention.

In a third embodiment shown in FIG. 6, the cover is identical to that of the first embodiment, with the difference being that the security strip 202 further includes additional security signs 212 (only some of which are given a reference in this figure).

The sleeve 201 itself also includes additional security signs 213.

By way of example, the security signs 212, 213 of the sleeve 201 and of the security strip 202 may comprise a numerical code, a barcode, a QR code (or two dimensional barcode), a number, a holographic element, a logo, an element in relief, . . . . The security signs 212, 213 may use specific inks, present a three-dimensional effect, a color effect, or indeed a metallic effect, . . . .

When the security strip 202 tears at its zones of weakness, the security signs 212 carried by the security strip 202 are destroyed or at the very least damaged due to separation of the security strip 202 into several elements. It is thus found to be extremely difficult to reconstitute the security signs 212 when attempting to put the security strip 202 back into place on the sleeve 201, thereby even further reinforcing the security of the security cover.

Preferably, the security signs marked on the sleeve 201 and/or on the security strip 202 comprise data specific to the container that the security cover is to cover. For example, at least one of the security signs is established on the basis of a unique identity code that is specific to the container for covering. A security sign that varies from one container to another thereby increases the security of the cover.

The various security signs 212, 213 are applied by any appropriate means on their respective media. By way of example, they can be printed on the security strip 202 or on the sleeve 201.

In a variant or in addition, the security signs 212, 213 include printing that is transferable onto the wall of the container. By way of example, these signs are printed on the inside face of the sleeve 201 and/or of the security strip 202 and their outlines are microperforated. The surface of the printing is preferably coated in a heat-activated glue, also known as heat-sensitive adhesive, such that when the sleeve 201 is subjected to heat shrinking, the portion of the sleeve 201 or of the security strip 202 that carries the printing becomes stuck to the wall of the container. The surface of the transferable printing may nevertheless be coated in any type of adhesive material that enables the printing to adhere to the wall of the container. The adhesive material may thus equally well be a cold-setting adhesive.

Thus, when the sleeve 201 is removed, the printing remains in place on the wall of the container and marks the container itself: the security sign thus remains invisible from the outside until the sleeve is broken.

Figure 7A:
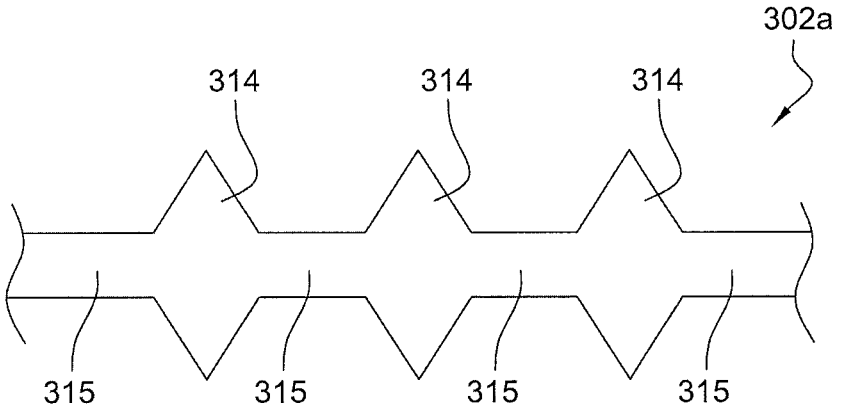
FIGS. 7*a*, 7*b*, and 7*c* are diagrammatic views of variants of the security strip of the cover shown in FIG. 1.

The invention therefore lends itself to numerous variants. Thus, with reference to FIGS. 7*a* to 7*c*, the security strip may be shaped in some way other than sinusoidally, as in the first embodiment. Instead of small waves, the security strip may thus comprise a succession of geometric elements connected to one another by linear portions. By way of example, as shown in FIG. 7*a*, the security strip 302*a* is shaped so as to be formed by lozenge shapes 314 connected to one another by flat portions 315.

Figure 7B:
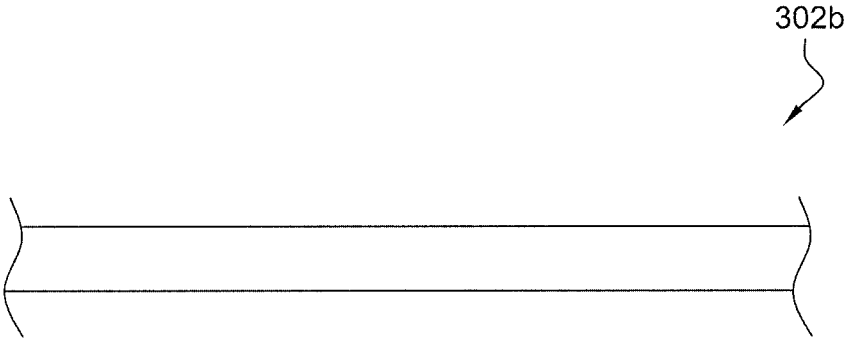
Figure 7C:
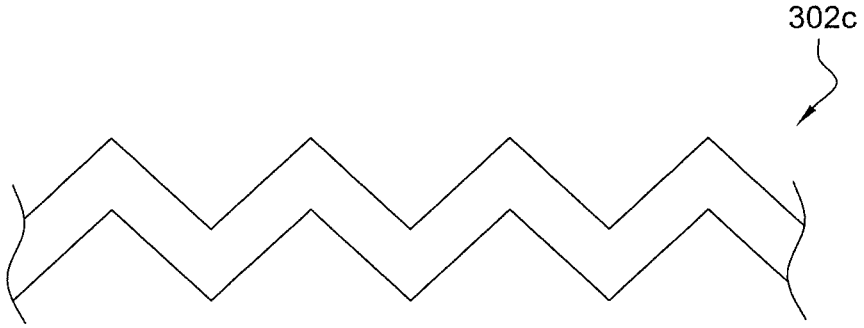

The security strip 302*c* may also form a zigzag as presented in FIG. 7*c*.

It is also possible for the security strip 302*b* not to form a crown, but to form a simple annulus as presented in FIG. 7*b*.

However, preference should be given to having a more elaborate crown shape for the security strip so as to create a stronger visual indicator. This further weakens the security strip and increases its tendency to fall apart.

In advantageous manner, it is thus possible to adapt the shape of the security strip in accordance with the requirements and wishes of a client. It is also possible to customize the color of the security strip. It is also possible to customize the security signs that may be present on the security strip.

This makes the cover particularly customizable and adaptable to the requirements of each client.

Figure 8:
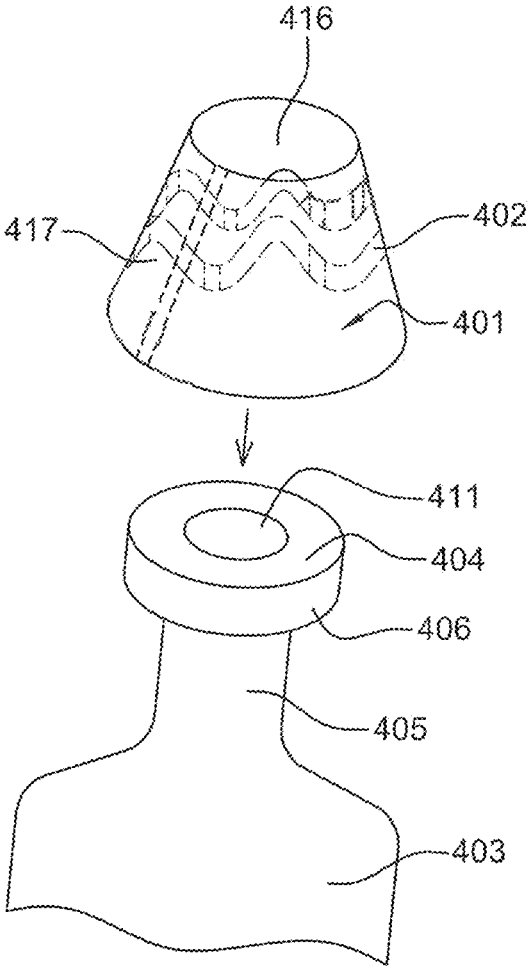
FIG. 8 is a diagrammatic perspective view of a security cover in a fourth embodiment of the invention and of a container designed to receive said cover.

With reference to FIG. 8, in a fourth embodiment of the invention, instead of being tubular in shape as in the other embodiments, the sleeve 401 is shaped into a capsule.

The capsule is typically in the form of a truncated cone with a closed top base 416 for covering entirely the top end of the container 403 and a skirt 417 extending from said top base 416 and designed to surround the finish 404 and a portion of the neck 405. In a variant, the capsule is cylindrical.

The cover is then threaded over the container 403, in this embodiment closed by a stopper 411, and then heated to cause the cover 401 to heat-shrink onto the neck 405 and the finish 404 of the container 403, so as to cover all of the stopper 411. Thus, the cover seals the stopper 411 to the finish 404.

Naturally, even with a cover of this shape, the security strip 402 always surrounds the container 403 immediately underneath the finish 404 of the container 403 so as to create a compression band compressing the container 403 at the lip 406.

Figure 9:
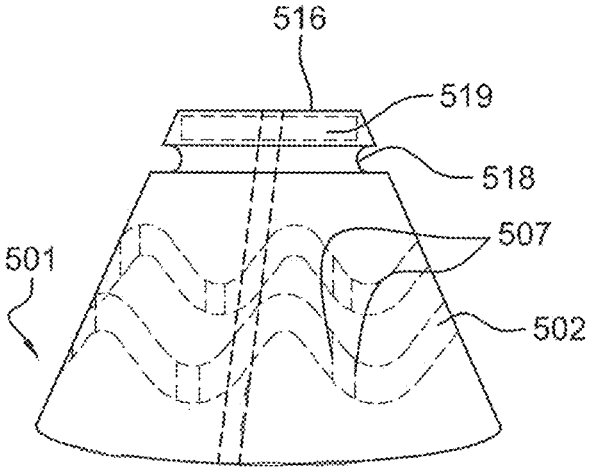
FIG. 9 is a diagrammatic perspective view of a variant of the security cover shown in FIG. 8.

With reference to FIG. 9, in a variant of the fourth embodiment, the sleeve 501 includes a trough 518 in the top portion of its skirt 516. In this embodiment, said trough 518 extends substantially over the entire circumference of the skirt 516. By means of this circumferential trough 518, there is therefore a tightening of the skirt 516 at this location. For ease of understanding, the dimensions of the trough 518 have been deliberately exaggerated in this example.

The cover further comprises a protection washer 519 that is arranged inside the sleeve 501 between the trough 518 and an inside face of the top base 516. The washer 519 thus bears on the trough 518 that enables the washer 519 to remain in place inside the cover while the cover is being manipulated. In particular, the washer 519 is connected to the cover by being arranged in this manner. In a variant it is also fastened to the cover, e.g. by adhesive.

Naturally, the washer 519 is of dimensions and made from a material that are adapted to limiting the risk of being pierced by an external object such as a syringe. By way of example, the washer 519 is a plate of metal.

Thus, when the cover is placed on the neck of a container, the washer 519 comes naturally into place on or slightly above the stopper.

It should be noted that the washer 519 thus extends through the sleeve 501 and inside the sleeve. In this embodiment, the washer 519 obstructs the top portion of the sleeve 501. As described, the washer 519 is cylindrical and presents a diameter that is substantially equal to that of the top base 516.

The cover is thus heated in order to cause the sleeve 501 to heat-shrink onto the neck and the finish, covering all of the stopper. Thus, the cover seals the stopper on the finish and at the same time seals the washer 519 with the stopper and the finish.

This makes it possible to further secure the container. The washer 519 resists any forced opening of the cover to access the contents of the container such as piercing the stopper with a syringe, for example. The washer 519 forms a shield preventing access to the stopper.

In order to reach the contents of the container, a person must then act on the cover so as to tear the security strip 502 as described above. This further enables the container to be secured very simply, since the washer 519 is put into position at the same time as the sleeve 501.

It is shown above that the invention lends itself to numerous variants. The following parameters may be varied in order to define the security strip:

- the material of the security strip;
- the shape and the dimensions of the security strip, in particular its thickness;
- the shrinking force of the security strip;
- the type of adherence to the sleeve (if adhesive is used, adhering may for example be permanent, partial, or non-repositionable);
- customization of the security strip (e.g. added printing with inks that are visible in daylight and/or visible in other wavelengths such as for example ultraviolet or infrared, metallic add-ons, holographic add-ons, . . . ); and the positioning of the security strip relative to the other elements (printing, holograms, . . . ) making it possible to customize the sleeve, thus further making it possible to make fraudulent reproduction of the security cover more difficult.

In the same way, the sleeve may thus be defined by varying: the material of the sleeve; its shape and its dimensions (in particular its thickness); its shrinking force; its type of adherence to the container; its customization; and the positioning of the security strip relative to the rest of the sleeve.

The invention is not limited to the above description, but on the contrary covers any variant coming within the ambit defined by the claims.

In particular, although in this embodiment the sleeve is made of heat-shrink material, the sleeve may be made of some other material and may be applied on the container, e.g. by crimping. The sleeve may thus be a capsule such as those used on bottles of wine. The security strip thus forms a compression zone for compressing the container once the sleeve is in place on the container (e.g. by crimping or pressing).

In the same way, the security strip may be made of a heat-shrink material or of a non heat-shrink material.

Although in this example, the sleeve is transparent, the sleeve may be opaque. The sleeve may thus be made of opaque material or it may be covered with a layer of opaque agent. The sleeve may be transparent in certain zones and opaque in others.

In addition, the security strip may be opaque. The security strip may be made of opaque material or it may be covered in an opaque agent. The security strip may be transparent in certain zones and opaque in others.

In particular, although as described above the lines of cut define a removable portion that is separable from the remainder of the sleeve, there is no need to organize a portion that is separable. Provision may simply be made for one or more lines of cut to pass over the security strip, so as to cause a change of state of the security strip in the event of action on the sleeve. Also, lines of cut on the sleeve need not be provided, mere manipulation of the sleeve in an attempt to open the container being sufficient to cause the change of state of the security strip.

Therefore, lines of cut may also be provided that are of length that is shorter than the entire circumference of the sleeve or at the height of the sleeve.

The lines of cut and/or the portion cut away may be arranged on a portion of the sleeve so as to cover the security strip outside a zone of weakness of said strip or at a zone of weakness of said strip. In addition, the lines of cut and/or the portion cut away may be arranged on a portion of the sleeve so as to cover the security strip at a security sign of said strip. In addition, the portion cut away may be arranged on a portion of the sleeve so as to cover all the security signs of the security strip.

The zones of weakness of the security strip may be different to those described above. By way of example, the zones of weakness need not include cuts, but rather a particular composition of the remainder of the security strip so that the zones of weakness change color relative to the remainder of the security strip in the event of action on the sleeve.

Figure 11:
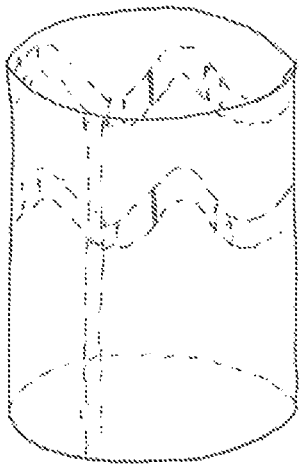
FIG. 11 is a diagrammatic perspective view of a security cover having the security strips in two portions.

Instead of extending over the entire circumference of the sleeve (and therefore of the container associated therewith), the security strip may extend over a portion only of the circumference of the sleeve. The security strip may thus be made in several portions that are separated from one another and distributed over the entire periphery of the circumference of the sleeve. Typically, the security strip may be made in two portions (see FIG. 11), the two portions extending symmetrically relative to each other over the circumference of the sleeve.

The cover need not include a protection washer. The cover may include a trough, even when shaped as a cylinder or a truncated cone or any other shape.

Figure 10:
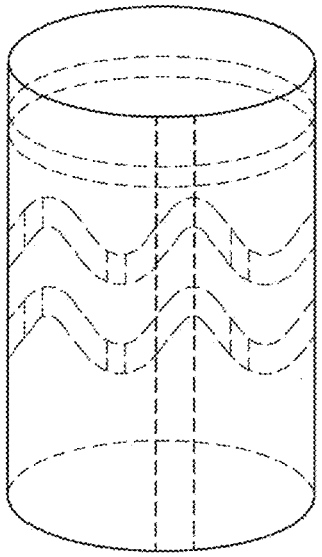
FIG. 10 is a diagrammatic perspective view of a security cover in a fifth embodiment of the invention.

As shown in FIG. 10, the cover may include a protection washer combined with a tubular sleeve, the washer being, for example, adhesively bonded at its periphery to the inside face of the sleeve so as not to move when the sleeve is manipulated. The washer thus extends transversely to the sleeve and to the inside of the sleeve.

The invention claimed is:

1. A security cover designed to surround a container, the cover comprising a sleeve and a security strip secured to an inside face of said sleeve and including at least one zone of weakness, the security strip being shaped so that when in service it surrounds at least in part the container below a finish of the container and in the immediate proximity of said finish, the security strip thus creating a compression zone compressing the container, wherein the security strip is non-linear.

2. The security cover according to claim 1, wherein the zone of weakness forms a rupture zone of the security strip.

3. The security cover according to claim 2, wherein the zone of weakness is thus formed by a cut in the security strip.

4. The security cover according to claim 1, wherein the security strip is crown-shaped.

5. The security cover according to claim 1, wherein at least a portion of the security strip is in contact with a lip of the container.

6. The security cover according to claim 1, wherein the security strip further comprises at least one security sign.

7. The security cover according to claim 1, wherein the sleeve includes at least one line of cut extending at least in part in a portion of the sleeve covering the security strip.

8. The security cover according to claim 1, wherein the sleeve is shaped into a capsule.

9. The security cover according to claim 8, wherein the capsule is shaped into a truncated cone.

10. The security cover according to claim 1, further comprising a protection washer for a stopper of the container.

11. The security cover according to claim 10, wherein the sleeve includes a trough, the washer resting on the trough.

12. The security cover according to claim 10, wherein the washer is arranged inside the sleeve between the stopper and an inside face of a top base of the capsule.

13. The security cover according to claim 11, wherein the washer is secured to the sleeve.

14. The security cover according to claim 1, wherein the security strip is in two portions.

15. A container covered with a cover according to claim 1.

16. A security cover designed to surround a container, the cover comprising a sleeve and a security strip secured to an inside face of said sleeve and including at least one zone of weakness, the security strip being shaped so that when in service it surrounds at least in part the container below a finish of the container and in the immediate proximity of said finish, the security strip thus creating a compression zone compressing the container;

wherein the security strip is not a tear strip, and the security strip is non-linear.

17. A security cover designed to surround a container, the cover comprising a sleeve and a security strip secured to an inside face of said sleeve and including at least one zone of weakness, the security strip being shaped so that when in service it surrounds at least in part the container below a finish of the container and in the immediate proximity of said finish, the security strip thus creating a compression zone compressing the container;

wherein the security cover is configured so that the sleeve remains intact on the container in case of a change of state of the security strip;

wherein the security strip is non-linear.

18. The security cover of claim 17, wherein the security cover is configured so that the sleeve remains intact on the container in case of separation into several elements of the security strip.

19. A security cover designed to surround a container, the cover comprising a sleeve and a security strip secured to an inside face of said sleeve and including at least one zone of weakness, the security strip being shaped so that when in service it surrounds at least in part the container below a finish of the container and in the immediate proximity of said finish, the security strip thus creating a compression zone compressing the container; wherein the zones of weakness are formed by cuts extending in substantially perpendicular to an orientation of the security strip.

* * * * *